US012304713B2

(12) United States Patent
Bergmann et al.

(10) Patent No.: US 12,304,713 B2
(45) Date of Patent: May 20, 2025

(54) PACKAGING CONTAINER MADE OF A PLASTIC FILM IN THE FORM OF A SACK OR BAG, AND FILM TUBE FOR PRODUCING SUCH A PACKAGING CONTAINER

(71) Applicant: BISCHOF + KLEIN SE & CO. KG, Lengerich (DE)

(72) Inventors: Reinhard Bergmann, Wallenhorst (DE); Frank Heermann, Lotte (DE); Waldemar Repp, Hagen A.T.W. (DE)

(73) Assignee: BISCHOF+KLEIN SE & CO. KG, Lengerich (DE)

( * ) Notice: Subject to any disclaimer, the term of this patent is extended or adjusted under 35 U.S.C. 154(b) by 102 days.

(21) Appl. No.: 18/030,505

(22) PCT Filed: Sep. 14, 2021

(86) PCT No.: PCT/EP2021/075212
§ 371 (c)(1),
(2) Date: Apr. 6, 2023

(87) PCT Pub. No.: WO2022/073728
PCT Pub. Date: Apr. 14, 2022

(65) Prior Publication Data

US 2023/0399159 A1 Dec. 14, 2023

(30) Foreign Application Priority Data

Oct. 8, 2020 (DE) ..... 20 2020 105 765.0

(51) Int. Cl.
*B65D 75/40* (2006.01)
*B65D 65/42* (2006.01)
(Continued)

(52) U.S. Cl.
CPC ..... *B65D 75/40* (2013.01); *B65D 65/42* (2013.01); *B65D 75/563* (2013.01); *B65D 75/5827* (2013.01)

(58) Field of Classification Search
CPC .. B65D 75/40; B65D 75/563; B65D 75/5827; B65D 65/42
(Continued)

(56) References Cited

U.S. PATENT DOCUMENTS 5,048,976 A 9/1991 Jung et al.
6,010,004 A * 1/2000 Huckriede ..... B65D 77/30 206/804
(Continued)

FOREIGN PATENT DOCUMENTS

DE 3232321 C2 * 9/1988
DE 20 2011 106 245 U1 2/2013
(Continued)

OTHER PUBLICATIONS

Machine translation of EP 2 272 769 A1. (Year: 2011).*

*Primary Examiner* — Jes F Pascua
(74) *Attorney, Agent, or Firm* — Norman B. Thot

(57) ABSTRACT

A packaging container made of a plastic film. The packaging container includes a receptacle space for goods arranged between a front wall and a rear wall, an upper and a lower traverse seam which closes the packaging container on an upper and a lower end, respectively, connecting seams running between the upper and lower traverse seams, a film strip fastened to an internal side of the front wall via the connecting seams, a longitudinal channel formed by the film strip, the front wall and the connecting seams, and an engagement element arranged in the longitudinal channel. The engagement element is arranged transversely to a longitudinal extent of the longitudinal channel, and in a cross section above the film strip, to permit an engagement in the
(Continued)

longitudinal extent of the longitudinal channel between the front wall and the film strip. The engagement element forms a handle with the front wall.

20 Claims, 2 Drawing Sheets

(51) Int. Cl.
*B65D 75/56* (2006.01)
*B65D 75/58* (2006.01)

(58) Field of Classification Search
USPC ..... 383/10
See application file for complete search history.

(56) References Cited

U.S. PATENT DOCUMENTS

| | | | | |
|---|---|---|---|---|
| 2009/0202181 | A1 | 8/2009 | Alaux | |
| 2017/0253382 | A1* | 9/2017 | Zum-Dohme | B65D 33/02 |

FOREIGN PATENT DOCUMENTS

| | | | | |
|---|---|---|---|---|
| EP | 0 341 532 | A1 | 11/1989 | |
| EP | 1600399 | A1 * | 11/2005 | B65D 33/01 |
| EP | 2 272 769 | A1 | 1/2011 | |
| EP | 2272772 | A1 * | 1/2011 | B65D 33/08 |
| EP | 2955126 | A2 * | 12/2015 | B65D 33/01 |
| EP | 3 052 396 | | 1/2019 | |

* cited by examiner

PACKAGING CONTAINER MADE OF A PLASTIC FILM IN THE FORM OF A SACK OR BAG, AND FILM TUBE FOR PRODUCING SUCH A PACKAGING CONTAINER

CROSS REFERENCE TO PRIOR APPLICATIONS

This application is a U.S. National Phase application under 35 U.S.C. § 371 of International Application No. PCT/EP2021/075212, filed on Sep. 14, 2021 and which claims benefit to German Patent Application No. 20 2020 105 765.0, filed on Oct. 8, 2020. The International Application was published in German on Apr. 14, 2022 as WO 2022/073728 A1 under PCT Article 21(2).

FIELD

The present invention relates to a packaging container made of plastic film in the form of a bag or pouch, having a front and a rear wall, and a receptacle space configured between these walls for goods to be stored. The external side of the front wall is printed with an identification mark or advertisement and is free of a longitudinal seam closing the packaging container. The packaging container is closed by transverse seams on the upper end thereof and on the lower end thereof. The packaging container comprises a film strip which by way of two connecting seams running between the two transverse seams is fastened to the internal side of the front wall and, conjointly with the front wall and the two connecting seams, forms a longitudinal channel. The present invention also relates to a tubular film for producing a packaging container of this type.

BACKGROUND

A packaging container of this type is described in EP 3 052 396 B1. The bag described therein can be produced in a cost-effective manner by a form-fill-seal method (FFS method) in that a tubular film with a length of often more than 1000 m is delivered as roll material to the filling establishment, and, at the latter, bags from the tubular film are continuously provided with a lower transverse seam and severed from the tubular film on special FFS packaging lines (form), the bags which now are open only at one end are filled (fill), and after filling, are closed by a further transverse seam (seal). Excess air which is still located in the receptacle space after the bag has been closed, can escape from the receptacle space into the longitudinal channel via ventilation openings in the film strip, and from there via a further ventilation opening in the transverse seam to the outside. The further ventilation is kept as small as possible in order to avoid any ingress of moisture from the outside into the receptacle space. The bag is carried by being engaged from below, which is not very comfortable.

The prior art also describes plastic film bags for hygiene items, such as toilet paper, which are likewise produced by the FFS method and in which the goods to be transported are accommodated in the actual bag, and an extension region having a handle is attached to this bag. The bag can easily be transported by the handle. The additional input of material which is required for the handle region is, however, disadvantageous. The overall length of the bag is extended by the film region required for attaching the handle. For larger packaging sizes, a bag of this type must be held at the handle using an angled arm in order to avoid contact between the bag and the floor.

A bag which can also be produced by the FFS method is described in DE 2020 11 106 245 U1, the bag having circumferential sides that form a tubular shape and of which at least one circumferential side has a continuous internal longitudinal seam for connecting two mutually overlapping film peripheries. The external film periphery here forms a cover strip via a predefined projection beyond the longitudinal seam. The cover strip usually covers ventilation openings toward the interior of the bag, with further ventilation openings existing toward the outside. A carrying handle is configured on the cover strip. The material input for a bag of this type is significantly less than in the aforementioned bag, and the bag length also does not exceed the length required for packaging the goods. The longitudinal seam is, however, located on the rear side of the bag, i.e., the rear side in the state of a bag lying down facing away from an observer, because the longitudinal seam would otherwise distort a printed image in the form of an identification mark or an advertisement on the bag. The carrying handle is thereby also located on the rear side of the bag and cannot be directly gripped.

SUMMARY

An aspect of the present invention is to provide a packaging container of the type mentioned above which can be produced by the FFS method, and a tubular film for producing the packaging container, where the aforementioned disadvantages are reduced.

In an embodiment, the present invention provides a packaging container made of a plastic film in the form of a bag or a pouch. The packaging container includes a front wall comprising an external side which is printed with an identification mark or with an advertisement and which does not comprise a longitudinal seam which closes the packaging container, a rear wall, a receptacle space arranged between the front wall and the rear wall for at least one good to be stored, an upper traverse seam which closes the packaging container on an upper end, a lower traverse seam which closes the packaging container on a lower end, two connecting seams which run between the upper traverse seam and the lower traverse seam, a film strip which is fastened to an internal side of the front wall via the two connecting seams, a longitudinal channel which is formed by the film strip, the front wall and the two connecting seams, and at least one engagement element which is arranged in the longitudinal channel. The at least one engagement element is arranged transversely to a longitudinal extent of the longitudinal channel over an extent of at least 45 mm, and in a cross section above the film strip, so as to permit an engagement in the longitudinal extent of the longitudinal channel between the front wall and the film strip. The at least one engagement element forms a handle conjointly with the front wall.

BRIEF DESCRIPTION OF THE DRAWINGS

The present invention is described in greater detail below on the basis of embodiments and of the drawings in which.

DETAILED DESCRIPTION

Figure 2:
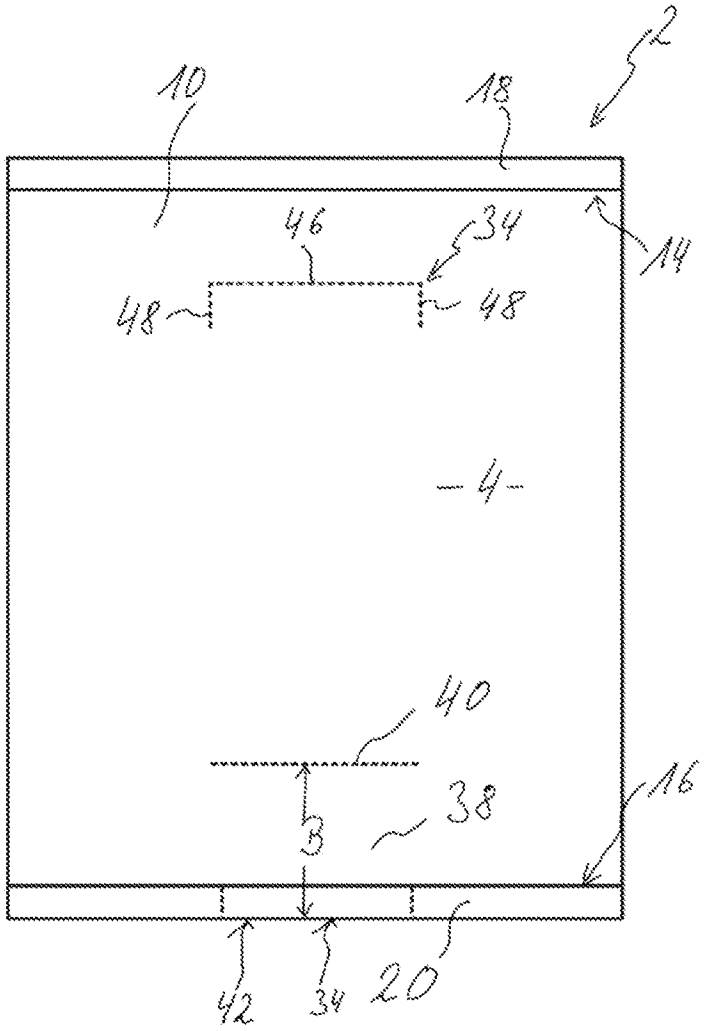
FIG. 2 shows a further packaging container according to the present invention in a view onto the front wall.

The packaging container according to the present invention has at least one engagement element in the longitudinal channel which is disposed transversely to the longitudinal extent of the longitudinal channel over an extent of at least 45 mm, and in the cross section above the film strip, so as to permit an engagement in the longitudinal extent of the longitudinal channel between the front wall and the film strip, and conjointly with the front wall forms a handle. As a result of the disposal of the handle provided in this manner as part of the front wall, the handle in the case of a packaging container lying down on the rear wall faces an operator and can therefore be easily gripped. The handle is also part of the bag of the packaging container per se and is not disposed in a separate region outside the actual bag. Material can therefore be saved. The engagement element is disposed transversely to the longitudinal extent of the longitudinal channel and thus to the longitudinal extent of the packaging container per se. An operator can therefore carry the bag by engaging in the engagement element with one hand, or with the fingers of one hand, without having to unnaturally twist the palm of the hand.

In a design embodiment of the present invention, the longitudinal channel can, for example, be closed toward the receptacle space. Fine particles of the packaged material from the receptacle space cannot therefore invade the longitudinal channel and from there make their way to the outside via the engagement element, or contaminate the hand or individual fingers of an operator when carrying the packaging container. The goods in the receptacle space can at the same time also not be contaminated via contact with the hand or individual fingers of an operator.

The film strip advantageously has an embossing in the region between the two connecting seams, the embossing particularly having, for example, protuberances, for example, pimples, toward the front wall. As a result of the embossing, adhesive forces between the internal side of the front wall and the film strip are reduced so that an engagement of an operator into the longitudinal channel via the engagement element is facilitated.

In a design embodiment of the present invention, the film strip can, for example, be composed of a film material which is different from the front and the rear wall of the packaging container, and the film material of the film strip (22) at a film thickness of more than 160 μm has a 2% secant modulus of 250 to 500 $N/mm^2$, at a film thickness of 120 to 160 μm has a 2% secant modulus of 200 to 400 $N/mm^2$, and at the film thickness of 80 to 120 μm has a 2% secant modulus of 100 to 350 $N/mm^2$. This design embodiment provides that the stiffness of a potential embossing of the film strip is increased so that the embossing is not pressed flat against the front wall by contact pressure exerted on the film strip by a packaged material.

In a design embodiment of the present invention, a longitudinal seam closing the packaging container in the circumferential direction can, for example, be disposed on the rear wall, and the film strip in the cross section is in each case positioned in the region of the transverse seams next to this longitudinal seam. This means that the film strip and the longitudinal seam do not lie on top of one another in the region of the transverse seams. The connecting seams in the region of the transverse seams can, for example, in particular not lie above or below the longitudinal seam but likewise next to the latter. These design embodiments in each case achieve that the transverse seams remain as thin as possible and can be reliably and rapidly produced. No significant elevations which could compromise the production of the packaging container by the FFS method are at the same time created as a result in the region of the transverse seams.

The packaging container advantageously comprises a grip facilitating element in the form of a linear weakening in the front wall, in particular a perforation or score line, which is assigned to one of the engagement elements and has a spacing of 3 to 12 cm from this engagement element. A plurality of fingers, or an entire hand, of an operator can thus engage in the longitudinal channel via the engagement element, and the fingertips can in this instance protrude from the channel toward the outside via the grip facilitating element in the front wall. This facilitates the carrying of the packaging container by hand or else with only a plurality of fingers.

In a design embodiment of the present invention, a first engagement element can, for example, be disposed in the region of the upper end of the packaging container, and a further engagement element can, for example, be disposed in the region of the lower end of the packaging container. The packaging container can thereby be carried simultaneously with two hands or at least the fingers of two different hands. A first hand engages in the first engagement element, and the second hand engages in the further engagement element. A comparatively large packaging container can in particular be carried at a sufficient spacing from the floor as a result, and the weight of the packaging container is at the same time distributed among both arms of the operator.

At least one engagement element is advantageously an opening. An operator can engage in the longitudinal channel directly via the opening and carry the packaging container.

In a design embodiment of the present invention, the engagement element in the form of the opening can, for example, at least partially interrupt one of the transverse seams between the film strip and the front wall. The engagement element can thereby be positioned in a cost-effective manner and to be unobtrusive. As a result of this positioning, the packaging container can also be carried in a particularly comfortable manner, depending on the length thereof.

In order for the opening to be configured, an anti-seal coating can, for example, be applied to the internal side of the front wall between the connecting seams of the longitudinal channel. An anti-seal coating is alternatively or additionally advantageously applied to the film strip between the connecting seams of the longitudinal channel. The anti-seal coatings prevent in each case that the film strip connects to the front wall in the region of the transverse seam during the production of the transverse seam. The anti-seal coating can, for example, be formed by a lacquer suitable for this purpose or a release coating. The anti-seal coating is advantageously applied to a non-corona treated area. The anti-seal coat thereby adheres on the corresponding plastic film to a sufficient but weaker degree so that the opening is configured with a greater probability.

In a design embodiment of the present invention, a safety spacing of at least 1 mm, in particular of 5 to 15 mm, for example, of 7 to 10 mm, can in each case be disposed between the two connecting seams and the anti-seal coating. This design embodiment provides that none of the connecting seams, or the material of one of these connecting seams, is partially in contact with the anti-seal coating, so as to thereby weaken or even interrupt the connection between the film strip and the internal side of the front wall.

A safety spacing of at least 1 mm, in particular of 5 to 15 mm, for example, of 7 to 10 mm, can in each case be advantageously disposed between the outer edges of the film strip and the connecting seams. This design embodiment provides that the material of the connecting seams is not partially positioned beyond the outer edge of the film strip and unintentionally connects the internal side of the front wall to the internal side of the rear wall.

In a design embodiment of the present invention, at least one engagement element can, for example, be a linear weakening, in particular a perforation or score line, which is disposed in the front wall. The linear weakening can, for example, here be configured so that an operator can open the linear weakening in a toolless manner, i.e., without tools and by hand, and as a result can gain access into the longitudinal channel. The film is torn open along the linear weakening. This design embodiment is particularly expedient in the case of long packaging containers. In this instance, the linear weakenings can be positioned so that the packaging container either can be gripped with two hands, wherein each of the hands engages in a dedicated engagement element, and the hands in the process are positioned at a mutual spacing which is comfortable for the operator. The packaging container is alternatively gripped at the handle by only one hand, and the arm of the gripping hand need not be unnaturally heavily angled in order to avoid the packaging container being dragged on the floor.

In a design embodiment of the present invention, at least one engagement element can, for example, be configured so as to be substantially U-shaped with a base and two legs adjoining the latter, wherein the base is 8 to 15 cm wide, and the legs are 1 to 3 cm long. When a hand engages in the engagement element, the part of the film of the front wall located between the two legs is folded into the longitudinal channel and therein doubles the film material. This can in particular be comfortable in the case of a heavy packaging container because the handle formed by the front wall in this instance cuts less into the hand of the operator.

The longitudinal channel can, for example, reach from the transverse seam at the lower end of the packaging container to the transverse seam at the upper end of the packaging container. The longitudinal channel thus extends across the entire length of the packaging container. This arrangement provides that the tubular film for producing the packaging container can be produced in a particularly simple and cost-effective manner.

The connecting seams can, for example, be composed of a hot-melt glue and can moreover advantageously run parallel to the film strip and parallel to the longitudinal extent of the packaging container.

The engagement element in the transverse direction can, for example, not extend beyond the extent of the front wall. The engagement element in the transverse direction can, for example, not be wider than 15 cm. The engagement element in the transverse direction advantageously extends in particular by 8 to 12 cm.

In a design embodiment of the present invention, the film strip can, for example, be composed of a film material which is different from the front and the rear wall of the packaging container. The film strip is in particular composed of a thinner film material than the plastic film of the front and the rear wall.

The film strip can, for example, be disposed so as to be centric on the internal side of the front wall. The handle which is formed by the engagement element in the longitudinal channel interacting with part of the front wall is thereby also positioned so as to be centric in the transverse direction on the front wall so that the packaging container can be carried more easily.

The packaging container can, for example, be a side gusseted bag or a flat bag. In the case of a side gusseted bag, the front and the rear wall are in each case understood to mean the region between the side gussets that surrounds the receptacle space outside the side gussets.

The packaging container according to the present invention can be produced by the FFS method described above in the context of EP 3 052 396 B 1. This is a special category of bags or pouches which are produced from a tubular film with a length of often more than 1000 m, filled and closed on special filling and packaging lines within a few seconds per packaging container. The piece costs per packaging container filled can thereby be kept very low. A bag or pouch produced by the FFS method is mandatorily composed of a plastic film and at the lower end and at the upper end is in each case closed by a transverse seam, for example, in the form of a hot-seal seam. The production rates typical for the FFS method cannot otherwise be achieved.

The present invention furthermore relates to a tubular film for producing a packaging container, having a front and a rear wall, wherein an external side of the front wall is printed with an identification mark or an advertisement, and is free of a longitudinal seam closing the tubular film. A film strip is fastened to an internal side of the front wall via two connecting seams running in the longitudinal direction of the tubular film, and conjointly with the front wall and the two connecting seams forms a longitudinal channel. An anti-seal coating is applied over an extent in the transverse direction of at least 45 mm on the internal side of the front wall, between the connecting seams of the longitudinal channel and/or on the film strip between the connecting seams. When this tubular film is used to produce a packaging container according to the present invention by the FFS method already described above, an opening as an engagement element, as has already been described above, is created as a result of the anti-seal coating in the region of the transverse seams of the packaging container incorporated between the film strips and the front wall.

A safety spacing of at least 1 mm, in particular of 5 to 15 mm, for example, of 7 to 10 mm, is advantageously disposed between each of the connecting seams and the anti-seal coating, and/or in each case between the outer edge of the film strip and the connecting seam closest to the latter. The longitudinal channel of the tubular film can, for example, be configured to be closed in the circumferential direction.

Further advantageous design embodiments and details of the present invention can be derived from the schematic exemplary embodiments described below under reference to the drawings.

Elements of the present invention with equivalent functions hereunder are provided with uniform reference signs to the extent expedient. The features of the exemplary embodiments described hereunder can also be the subject matter of the present invention in other combinations.

Figure 1:
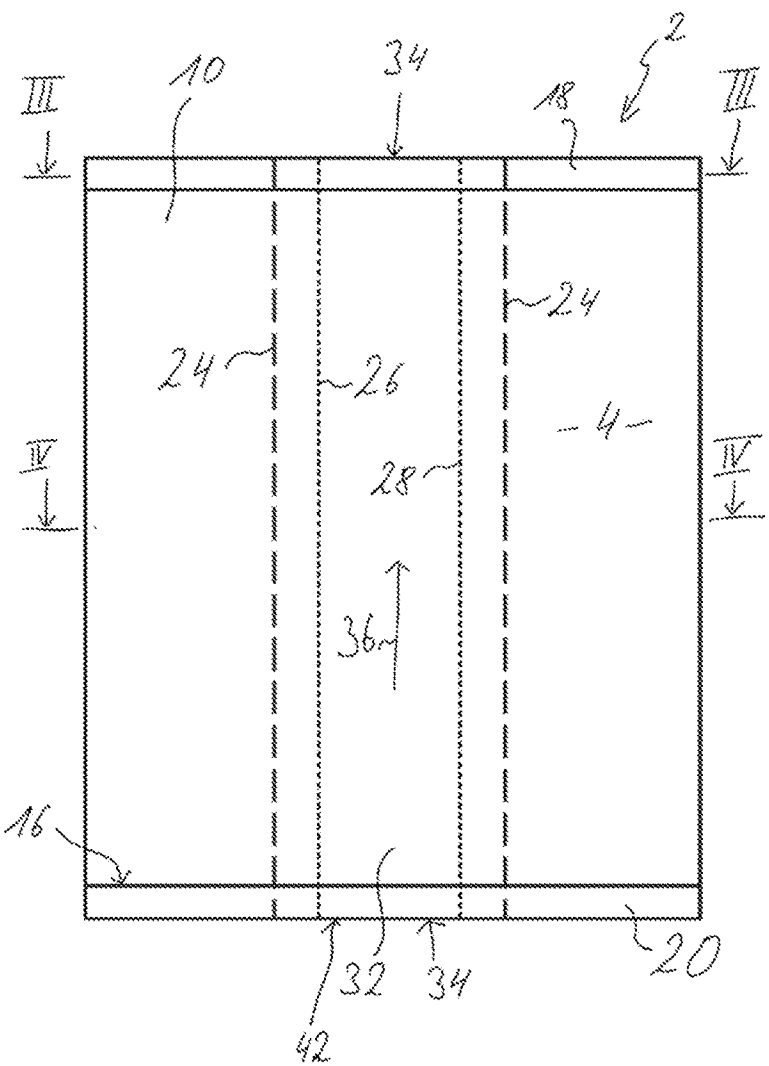
FIG. 1 shows a packaging container according to the present invention in a view onto the front wall.
Figure 4:
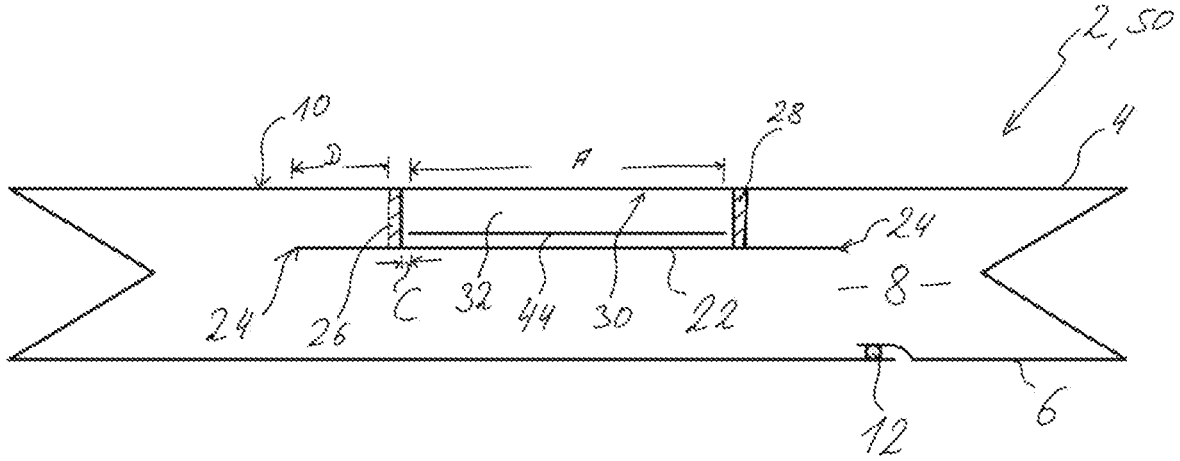
FIG. 4 shows a sectional illustration according to the line Iv-Iv in FIG. 1.

FIGS. 1 and 2 show in each case a packaging container (2) according to the present invention made of plastic film in the form of a bag or pouch, having a front wall (4) and a rear wall (6), the latter in FIGS. 1 and 2 being in each case obscured by the front wall (4). Configured between these walls (4, 6), is a receptacle space (8) for goods to be stored, the receptacle space (8) only being illustrated in FIG. 4. The external side (10) of the front wall (4) is printed with an identification mark or an advertisement, this is, however, not shown in the drawings. The front wall (4) is free of a longitudinal seam (12) closing the packaging container (2). FIG. 4 shows that the longitudinal seam (12) is located on the rear wall (6) of the packaging container (2).

Figure 3:
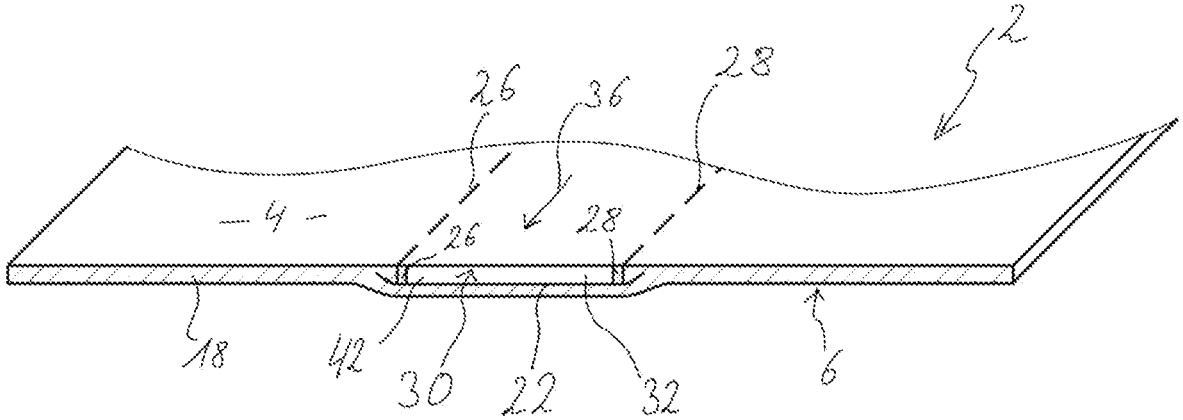
FIG. 3 shows a sectional illustration along the line III-III in FIG. 1.

The upper end (14) and the lower end (16) of the packaging container (2) is closed by transverse seams (18, 20). The packaging container (2) has a film strip (22) which is shown in FIGS. 3 and 4, the positioning of the outer edges (24) of the film strip (22) being shown by dashed lines in FIG. 1. The film strip (22) is fixed to the internal side (30) of the front wall (4) by two connecting seams (26, 28) running between the two transverse seams (18, 20), and conjointly with the front wall (4) and the two connecting seams (26, 28) forms a longitudinal channel (32). The positioning of the connecting seams (26, 28) is illustrated by dashed lines in FIG. 1.

The packaging container (2) has at least one engagement element (34) in the longitudinal channel (32). The positioning of the engagement element or engagement elements (34) is illustrated by arrows (34) in FIGS. 1 and 2. The engagement element (34) is disposed transversely to the longitudinal extent (36) of the longitudinal channel (32) over an extent A of at least 45 mm, and in the cross section, shown in FIGS. 3 and 4, above the film strip (22), so as to permit an engagement in the longitudinal extent (36) of the longitudinal channel (32) between the front wall (4) and the film strips (22), and conjointly with the front wall (4) forms a handle (38).

As can in particular be seen from FIG. 4, the longitudinal channel (32) is closed toward the receptacle space (8).

The film strip (22) in the region between the two connecting seams (26, 28) has an embossing which has elevations toward the internal side (30) of the front wall (4) but is not illustrated in the drawings.

Disposed on the rear wall (6) is a longitudinal seam (12) which closes the packaging container (2) in the circumferential direction. The film strip (22) in the cross section is in each case positioned in the region of the transverse seams (18, 20) next to this longitudinal seam (12), as can be seen from FIGS. 3 and 4.

The packaging container illustrated in FIG. 2 comprises a grip facilitating element (40) in the form of a linear weakening in the front wall (4), the grip facilitating element (40) being assigned to the engagement element (34) at the lower end (16) of the packaging container (2). The grip facilitating element (40) has a spacing B of 3 to 12 cm from this engagement element (34).

In the exemplary embodiment in FIG. 1, both engagement elements (34) are formed by openings (42). In the exemplary embodiment in FIG. 2, only the engagement element (34) at the lower end (16) of the packaging container (2) is formed by an opening (42). The aforementioned openings (42) in the exemplary embodiments interrupt in each case partially one of the transverse seams (18, 20) between the film strip (22) and the front wall (4). An anti-seal coating (44) is in each case applied to the internal side (30) of the front wall and/or on the film strip (22) between the connecting seams (26, 28) of the longitudinal channel (32). This anti-seal coating (44) in FIG. 4 is illustrated on the film strip (22). A safety spacing C of at least 1 mm, in particular of 5 to 15 mm, is in each case disposed between the two connecting seams (26, 28) and the anti-seal coating (44). A further safety spacing D of at least 1 mm, in particular of 5 to 15 mm, is in each case likewise disposed between the outer edges (24) of the film strip (22) and the connecting seams (26, 28).

An engagement element (34) in the form of a linear weakening, in particular a perforation or score line, is disposed in the front wall (4) in FIG. 2. This engagement element (34) is configured so as to be substantially U-shaped with a base (46) and two legs (48) adjoining the latter. The base (46) is here 8 to 15 cm wide, and the legs (48) are 1 to 3 cm long.

The illustration in FIG. 4 is moreover identical to a cross section through a tubular film (50) according to the present invention. The elements illustrated and referenced in FIG. 4 for the packaging container (2) according to the present invention are likewise also present in the tubular film (50) and are therefore not separately repeated.

The present invention is not limited to embodiments described herein; reference should be had to the appended claims.

LIST OF REFERENCE CHARACTERS

2 Packaging container
4 Front wall
6 Rear wall
8 Receptacle space
10 External side (of the front wall 4)
12 Longitudinal seam
14 Upper end (of the packaging container 2)
16 Lower end (of the packaging container 2)
18 Transverse seam (top)
20 Transverse seam (bottom)
22 Film strip
24 Outer edges (of the film strip 22)
26 Connecting seam
28 Connecting seam
30 Internal side (of the front wall 4)
32 Longitudinal channel
34 Engagement element
36 Longitudinal extent (of the longitudinal channel 32)
38 Handle
40 Grip facilitating element
42 Opening
44 Anti-seal coating
46 Base
48 Leg
50 Tubular film
A Extent of the engagement element 34 in the transverse direction
B Spacing of the grip facilitating element 40 from the engagement
element 34
C Safety spacing
D Further safety spacing

What is claimed is:

1. A packaging container made of a plastic film in the form of a bag or a pouch, the packaging container comprising:

a front wall comprising an external side which is printed with an identification mark or with an advertisement and which does not comprise a longitudinal seam which closes the packaging container;

a rear wall;

a receptacle space arranged between the front wall and the rear wall for at least one good to be stored;

an upper traverse seam which closes the packaging container on an upper end;

a lower traverse seam which closes the packaging container on a lower end;

two connecting seams which run between the upper traverse seam and the lower traverse seam;

a film strip which is fastened to an internal side of the front wall via the two connecting seams;

a longitudinal channel which is formed by the film strip, the front wall and the two connecting seams; and at least one engagement element which is arranged in the longitudinal channel, the at least one engagement element being arranged transversely to a longitudinal extent of the longitudinal channel over an extent of at least 45 mm, and in a cross section above the film strip, so as to permit an engagement in the longitudinal extent of the longitudinal channel between the front wall and the film strip, wherein, the at least one engagement element forms a handle conjointly with the front wall, and the at least one engagement element is provided as a linear weakening which is arranged in the front wall.

2. The packaging container as recited in claim 1, wherein the linear weakening is a perforation or a score line.

3. A tubular film for producing the packaging container as recited in claim 1, the tubular film comprising:

a front wall comprising an internal side and an external side, the external side being printed with an identification mark or with an advertisement, the front wall not comprising a longitudinal seam which closes the packaging container;

a rear wall;

two connecting seams which run in a longitudinal direction of the tubular film;

a film strip which is fastened via the two connecting seams to the internal side of the front wall;

a longitudinal channel which is formed by the film strip, the front wall and the two connecting seams;

an anti-seal coating which is applied at least one of, on the internal side of the front wall, between the two connecting seams of the longitudinal channel, and, on the film strip between the two connecting seams, over an extent in a transverse direction of at least 45 mm, respectively; and a safety spacing of at least 1 mm arranged at least one of, between each of the two connecting seams and the anti-seal coating, and between an outer edge of the film strip and the respective one of the two connecting seams which is closest to the respective outer edge of the film strip.

4. A tubular film for producing the packaging container as recited in claim 1, the tubular film comprising:

a front wall comprising an internal side and an external side, the external side being printed with an identification mark or with an advertisement, the front wall not comprising a longitudinal seam which closes the packaging container;

a rear wall;

two connecting seams which run in a longitudinal direction of the tubular film;

a film strip which is fastened via the two connecting seams to the internal side of the front wall;

a longitudinal channel which is formed by the film strip, the front wall and the two connecting seams;

an anti-seal coating which is applied at least one of, on the internal side of the front wall, between the two connecting seams of the longitudinal channel, and, on the film strip between the two connecting seams, over an extent in a transverse direction of at least 45 mm, respectively; and a safety spacing of at least 1 mm arranged at least one of, between each of the two connecting seams and the anti-seal coating, and between an outer edge of the film strip and the respective one of the two connecting seams which is closest to the respective outer edge of the film strip, wherein, the longitudinal channel is configured to be closed in a circumferential direction.

5. A packaging container made of a plastic film in the form of a bag or a pouch, the packaging container comprising, a front wall comprising an external side which is printed with an identification mark or with an advertisement and which does not comprise a longitudinal seam which closes the packaging container;

a rear wall;

a receptacle space arranged between the front wall and the rear wall for at least one good to be stored;

an upper traverse seam which closes the packaging container on an upper end;

a lower traverse seam which closes the packaging container on a lower end;

two connecting seams which run between the upper traverse seam and the lower traverse seam;

a film strip which is fastened to an internal side of the front wall via the two connecting seams;

a longitudinal channel which is formed by the film strip, the front wall and the two connecting seams;

at least one engagement element which is arranged in the longitudinal channel, the at least one engagement element being arranged transversely to a longitudinal extent of the longitudinal channel over an extent of at least 45 mm, and in a cross section above the film strip, so as to permit an engagement in the longitudinal extent of the longitudinal channel between the front wall and the film strip, and a grip facilitating element which is provided as a linear weakening in the front wall, wherein, the at least one engagement element forms a handle conjointly with the front wall, the grip facilitating element is assigned to one of the at least one engagement element, and the grip facilitating element is arranged to have a spacing B of 3 to 12 cm from the one of the at least one engagement element.

6. The packaging container as recited in claim 5, wherein the linear weakening is a perforation or a score line.

7. A tubular film for producing the packaging container as recited in claim 5, the tubular film comprising:

a front wall comprising an internal side and an external side, the external side being printed with an identification mark or with an advertisement, the front wall not comprising a longitudinal seam which closes the packaging container;

a rear wall;

two connecting seams which run in a longitudinal direction of the tubular film;

a film strip which is fastened via the two connecting seams to the internal side of the front wall;

a longitudinal channel which is formed by the film strip, the front wall and the two connecting seams;

an anti-seal coating which is applied at least one of, on the internal side of the front wall, between the two connecting seams of the longitudinal channel, and, on the film strip between the two connecting seams, over an extent in a transverse direction of at least 45 mm, respectively; and a safety spacing of at least 1 mm arranged at least one of,
between each of the two connecting seams and the anti-seal coating, and
between an outer edge of the film strip and the respective one of the two connecting seams which is closest to the respective outer edge of the film strip.

8. A tubular film for producing the packaging container as recited in claim 5, the tubular film comprising:
a front wall comprising an internal side and an external side, the external side being printed with an identification mark or with an advertisement, the front wall not comprising a longitudinal seam which closes the packaging container;
a rear wall;
two connecting seams which run in a longitudinal direction of the tubular film;
a film strip which is fastened via the two connecting seams to the internal side of the front wall;
a longitudinal channel which is formed by the film strip, the front wall and the two connecting seams;
an anti-seal coating which is applied at least one of,
on the internal side of the front wall, between the two connecting seams of the longitudinal channel, and,
on the film strip between the two connecting seams, over an extent in a transverse direction of at least 45 mm, respectively; and
a safety spacing of at least 1 mm arranged at least one of,
between each of the two connecting seams and the anti-seal coating, and
between an outer edge of the film strip and the respective one of the two connecting seams which is closest to the respective outer edge of the film strip, wherein, the longitudinal channel is configured to be closed in a circumferential direction.

9. A packaging container made of a plastic film in the form of a bag or a pouch, the packaging container comprising:
a front wall comprising an external side which is printed with an identification mark or with an advertisement and which does not comprise a longitudinal seam which closes the packaging container;
a rear wall;
a receptacle space arranged between the front wall and the rear wall for at least one good to be stored;
an upper traverse seam which closes the packaging container on an upper end;
a lower traverse seam which closes the packaging container on a lower end;
two connecting seams which run between the upper traverse seam and the lower traverse seam;
a film strip which is fastened to an internal side of the front wall via the two connecting seams;
a longitudinal channel which is formed by the film strip, the front wall and the two connecting seams; and
at least one engagement element which is arranged in the longitudinal channel, the at least one engagement element being arranged transversely to a longitudinal extent of the longitudinal channel over an extent of at least 45 mm, and in a cross section above the film strip, so as to permit an engagement in the longitudinal extent of the longitudinal channel between the front wall and the film strip,
wherein,
the at least one engagement element forms a handle conjointly with the front wall,
the at least one engagement element is configured to be substantially U-shaped comprising a base and two legs adjoining the base,
the base is 8 to 15 cm wide, and
each of the two legs are 1 to 3 cm long.

10. A tubular film for producing the packaging container as recited in claim 9 the tubular film comprising:
a front wall comprising an internal side and an external side, the external side being printed with an identification mark or with an advertisement, the front wall not comprising a longitudinal seam which closes the packaging container;
a rear wall;
two connecting seams which run in a longitudinal direction of the tubular film;
a film strip which is fastened via the two connecting seams to the internal side of the front wall;
a longitudinal channel which is formed by the film strip, the front wall and the two connecting seams;
an anti-seal coating which is applied at least one of,
on the internal side of the front wall, between the two connecting seams of the longitudinal channel, and,
on the film strip between the two connecting seams, over an extent in a transverse direction of at least 45 mm, respectively; and
a safety spacing of at least 1 mm arranged at least one of,
between each of the two connecting seams and the anti-seal coating, and
between an outer edge of the film strip and the respective one of the two connecting seams which is closest to the respective outer edge of the film strip.

11. A tubular film for producing the packaging container as recited in claim 9, the tubular film comprising:
a front wall comprising an internal side and an external side, the external side being printed with an identification mark or with an advertisement, the front wall not comprising a longitudinal seam which closes the packaging container;
a rear wall;
two connecting seams which run in a longitudinal direction of the tubular film;
a film strip which is fastened via the two connecting seams to the internal side of the front wall;
a longitudinal channel which is formed by the film strip, the front wall and the two connecting seams;
an anti-seal coating which is applied at least one of,
on the internal side of the front wall, between the two connecting seams of the longitudinal channel, and,
on the film strip between the two connecting seams, over an extent in a transverse direction of at least 45 mm, respectively; and
a safety spacing of at least 1 mm arranged at least one of,
between each of the two connecting seams and the anti-seal coating, and
between an outer edge of the film strip and the respective one of the two connecting seams which is closest to the respective outer edge of the film strip,
wherein,
the longitudinal channel is configured to be closed in a circumferential direction.

12. A packaging container made of a plastic film in the form of a bag or a pouch, the packaging container comprising:
a front wall comprising an external side which is printed with an identification mark or with an advertisement and which does not comprise a longitudinal seam which closes the packaging container;
a rear wall;
a receptacle space arranged between the front wall and the rear wall for at least one good to be stored;

an upper traverse seam which closes the packaging container on an upper end;

a lower traverse seam which closes the packaging container on a lower end;

two connecting seams which run between the upper traverse seam and the lower traverse seam;

a film strip which is fastened to an internal side of the front wall via the two connecting seams;

a longitudinal channel which is formed by the film strip, the front wall and the two connecting seams; and at least one engagement element which is arranged in the longitudinal channel, the at least one engagement element being arranged transversely to a longitudinal extent of the longitudinal channel over an extent of at least 45 mm, and in a cross section above the film strip, so as to permit an engagement in the longitudinal extent of the longitudinal channel between the front wall and the film strip, wherein, the at least one engagement element forms a handle conjointly with the front wall, the film strip is made of a film material which is different from that of the front wall and the rear wall, the film material of the film strip at a film thickness of more than 160 μm has a 2% secant modulus of 250 to 500 $N/mm^2$, the film material of the film strip at a film thickness of 120 to 160 μm has a 2% secant modulus of 200 to 400 $N/mm^2$, and the film material of the film strip at a film thickness of 80 to 120 μm has a 2% secant modulus of 100 to 350 $N/mm^2$.

13. A tubular film for producing the packaging container as recited in claim 12, the tubular film comprising:

a front wall comprising an internal side and an external side, the external side being printed with an identification mark or with an advertisement, the front wall not comprising a longitudinal seam which closes the packaging container;

a rear wall;

two connecting seams which run in a longitudinal direction of the tubular film;

a film strip which is fastened via the two connecting seams to the internal side of the front wall;

a longitudinal channel which is formed by the film strip, the front wall and the two connecting seams;

an anti-seal coating which is applied at least one of, on the internal side of the front wall, between the two connecting seams of the longitudinal channel, and, on the film strip between the two connecting seams, over an extent in a transverse direction of at least 45 mm, respectively; and a safety spacing of at least 1 mm arranged at least one of, between each of the two connecting seams and the anti-seal coating, and between an outer edge of the film strip and the respective one of the two connecting seams which is closest to the respective outer edge of the film strip.

14. A tubular film for producing the packaging container as recited in claim 12, the tubular film comprising:

a front wall comprising an internal side and an external side, the external side being printed with an identification mark or with an advertisement, the front wall not comprising a longitudinal seam which closes the packaging container;

a rear wall;

two connecting seams which run in a longitudinal direction of the tubular film;

a film strip which is fastened via the two connecting seams to the internal side of the front wall;

a longitudinal channel which is formed by the film strip, the front wall and the two connecting seams;

an anti-seal coating which is applied at least one of, on the internal side of the front wall, between the two connecting seams of the longitudinal channel, and, on the film strip between the two connecting seams, over an extent in a transverse direction of at least 45 mm, respectively; and a safety spacing of at least 1 mm arranged at least one of, between each of the two connecting seams and the anti-seal coating, and between an outer edge of the film strip and the respective one of the two connecting seams which is closest to the respective outer edge of the film strip, wherein, the longitudinal channel is configured to be closed in a circumferential direction.

15. A packaging container made of a plastic film in the form of a bag or a pouch, the packaging container comprising:

a front wall comprising an external side which is printed with an identification mark or with an advertisement and which does not comprise a longitudinal seam which closes the packaging container;

a rear wall;

a receptacle space arranged between the front wall and the rear wall for at least one good to be stored;

an upper traverse seam which closes the packaging container on an upper end;

a lower traverse seam which closes the packaging container on a lower end;

two connecting seams which run between the upper traverse seam and the lower traverse seam;

a film strip which is fastened to an internal side of the front wall via the two connecting seams;

a longitudinal channel which is formed by the film strip, the front wall and the two connecting seams;

at least one engagement element which is arranged in the longitudinal channel, the at least one engagement element being arranged transversely to a longitudinal extent of the longitudinal channel over an extent of at least 45 mm, and in a cross section above the film strip, so as to permit an engagement in the longitudinal extent of the longitudinal channel between the front wall and the film strip; and an anti-seal coating, wherein, the at least one engagement element forms a handle conjointly with the front wall, the anti-seal coating is applied to the internal side of the front wall between the two connecting seams of the longitudinal channel, or the anti-seal coating is applied to the film strip between the two connecting seams of the longitudinal channel, and a safety spacing of at least 1 mm is arranged between the two connecting seams and the anti-seal coating.

16. A tubular film for producing the packaging container as recited in claim 15 the tubular film comprising:

a front wall comprising an internal side and an external side, the external side being printed with an identification mark or with an advertisement, the front wall not comprising a longitudinal seam which closes the packaging container;

a rear wall;

two connecting seams which run in a longitudinal direction of the tubular film;

a film strip which is fastened via the two connecting seams to the internal side of the front wall;

a longitudinal channel which is formed by the film strip, the front wall and the two connecting seams;

an anti-seal coating which is applied at least one of, on the internal side of the front wall, between the two connecting seams of the longitudinal channel, and, on the film strip between the two connecting seams, over an extent in a transverse direction of at least 45 mm, respectively; and a safety spacing of at least 1 mm arranged at least one of, between each of the two connecting seams and the anti-seal coating, and between an outer edge of the film strip and the respective one of the two connecting seams which is closest to the respective outer edge of the film strip.

17. A tubular film for producing the packaging container as recited in claim 15, the tubular film comprising:

a front wall comprising an internal side and an external side, the external side being printed with an identification mark or with an advertisement, the front wall not comprising a longitudinal seam which closes the packaging container;

a rear wall;

two connecting seams which run in a longitudinal direction of the tubular film;

a film strip which is fastened via the two connecting seams to the internal side of the front wall;

a longitudinal channel which is formed by the film strip, the front wall and the two connecting seams;

an anti-seal coating which is applied at least one of, on the internal side of the front wall, between the two connecting seams of the longitudinal channel, and, on the film strip between the two connecting seams, over an extent in a transverse direction of at least 45 mm, respectively; and a safety spacing of at least 1 mm arranged at least one of, between each of the two connecting seams and the anti-seal coating, and between an outer edge of the film strip and the respective one of the two connecting seams which is closest to the respective outer edge of the film strip, wherein, the longitudinal channel is configured to be closed in a circumferential direction.

18. A packaging container made of a plastic film in the form of a bag or a pouch, the packaging container comprising:

a front wall comprising an external side which is printed with an identification mark or with an advertisement and which does not comprise a longitudinal seam which closes the packaging container;

a rear wall;

a receptacle space arranged between the front wall and the rear wall for at least one good to be stored;

an upper traverse seam which closes the packaging container on an upper end;

a lower traverse seam which closes the packaging container on a lower end;

two connecting seams which run between the upper traverse seam and the lower traverse seam;

a film strip which is fastened to an internal side of the front wall via the two connecting seams;

a longitudinal channel which is formed by the film strip, the front wall and the two connecting seams;

at least one engagement element which is arranged in the longitudinal channel, the at least one engagement element being arranged transversely to a longitudinal extent of the longitudinal channel over an extent of at least 45 mm, and in a cross section above the film strip, so as to permit an engagement in the longitudinal extent of the longitudinal channel between the front wall and the film strip; and an anti-seal coating, wherein, the at least one engagement element forms a handle conjointly with the front wall, the anti-seal coating is applied to the internal side of the front wall between the two connecting seams of the longitudinal channel, or the anti-seal coating is applied to the film strip between the two connecting seams of the longitudinal channel, the film strip comprises outer edges, and a safety spacing of at least 1 mm is arranged between the outer edges of the film strip and the two connecting seams.

19. A tubular film for producing the packaging container as recited in claim 18, the tubular film comprising:

a front wall comprising an internal side and an external side, the external side being printed with an identification mark or with an advertisement, the front wall not comprising a longitudinal seam which closes the packaging container;

a rear wall;

two connecting seams which run in a longitudinal direction of the tubular film;

a film strip which is fastened via the two connecting seams to the internal side of the front wall;

a longitudinal channel which is formed by the film strip, the front wall and the two connecting seams;

an anti-seal coating which is applied at least one of, on the internal side of the front wall, between the two connecting seams of the longitudinal channel, and, on the film strip between the two connecting seams, over an extent in a transverse direction of at least 45 mm, respectively; and a safety spacing of at least 1 mm arranged at least one of, between each of the two connecting seams and the anti-seal coating, and between an outer edge of the film strip and the respective one of the two connecting seams which is closest to the respective outer edge of the film strip.

20. A tubular film for producing the packaging container as recited in claim 18, the tubular film comprising:

a front wall comprising an internal side and an external side, the external side being printed with an identification mark or with an advertisement, the front wall not comprising a longitudinal seam which closes the packaging container;

a rear wall;

two connecting seams which run in a longitudinal direction of the tubular film;

a film strip which is fastened via the two connecting seams to the internal side of the front wall;

a longitudinal channel which is formed by the film strip, the front wall and the two connecting seams;

an anti-seal coating which is applied at least one of, on the internal side of the front wall, between the two connecting seams of the longitudinal channel, and, on the film strip between the two connecting seams, over an extent in a transverse direction of at least 45 mm, respectively; and a safety spacing of at least 1 mm arranged at least one of, between each of the two connecting seams and the anti-seal coating, and between an outer edge of the film strip and the respective one of the two connecting seams which is closest to the respective outer edge of the film strip, wherein, the longitudinal channel is configured to be closed in a circumferential direction.

* * * * *